US007208255B2

(12) United States Patent
Kim et al.

(10) Patent No.: US 7,208,255 B2
(45) Date of Patent: Apr. 24, 2007

(54) POWDER-COATED TONER PARTICLES AND METHOD OF MAKING SAME

(75) Inventors: Chul-Hwan Kim, Daejon (KR); Kyung Hee Kim, Seoul (KR); Eui Joon Choi, Anyang-shi (KR); Hyun-Nam Yoon, Towaco, NJ (US)

(73) Assignee: DPI Solutions, Incorporated, Daejon (KR)

( * ) Notice: Subject to any disclaimer, the term of this patent is extended or adjusted under 35 U.S.C. 154(b) by 278 days.

(21) Appl. No.: 10/830,173

(22) Filed: Apr. 22, 2004

(65) Prior Publication Data

US 2005/0142476 A1 Jun. 30, 2005

(30) Foreign Application Priority Data

May 14, 2003 (KR) ..... 10-2003-0030477

(51) Int. Cl.
*G03G 9/093* (2006.01)

(52) U.S. Cl. ..... 430/108.4; 430/110.1; 430/111.4; 430/137.11

(58) Field of Classification Search ..... 430/108.4, 430/108.8, 110.1, 110.2, 110.4, 111.4, 137.11
See application file for complete search history.

(56) References Cited

U.S. PATENT DOCUMENTS

| | | | | |
|---|---|---|---|---|
| 2,297,691 A | | 10/1942 | Carlson | 95/5 |
| 4,254,201 A | * | 3/1981 | Sawai et al. | 430/110.2 |
| 4,645,727 A | | 2/1987 | Ong et al. | 430/106 |
| 4,778,742 A | | 10/1988 | Ong et al. | 430/106 |
| 4,837,107 A | * | 6/1989 | Axelsson et al. | 430/137.11 |
| 4,935,326 A | | 6/1990 | Creatura et al. | 430/108 |
| 4,937,166 A | | 6/1990 | Creatura et al. | 430/108 |
| 5,102,761 A | | 4/1992 | Ohsaki et al. | 430/106 |
| 5,200,290 A | | 4/1993 | Ong et al. | 430/115 |
| 5,296,325 A | | 3/1994 | Ohtsuka et al. | 430/106 |
| 5,352,521 A | | 10/1994 | Hotta et al. | 428/402 |
| 5,437,953 A | | 8/1995 | Russell et al. | 430/106 |
| 5,470,687 A | | 11/1995 | Mayama et al. | 430/137 |
| 5,500,321 A | | 3/1996 | Kasuya et al. | 430/109 |
| 5,916,735 A | | 6/1999 | Nakashima et al. | 430/314 |
| 6,132,919 A | | 10/2000 | Ogawa et al. | 430/110 |
| 6,268,103 B1 | | 7/2001 | Hopper et al. | 430/137.14 |
| 6,416,918 B2 | * | 7/2002 | Matsumura et al. | 430/110.4 |

OTHER PUBLICATIONS

Powder Technology Handbook, 2nd edition, Marcell Dekker Publications (1997), pp. 3-13, by K. Gotoh et al.

* cited by examiner

*Primary Examiner*—John L Goodrow
(74) *Attorney, Agent, or Firm*—Michael W. Ferrell

(57) ABSTRACT

A color toner composition for developing latent electrostatic images includes nanopowder-coated toner particles, the powder-coated toner particles being characterized in that each comprises a core toner particle having a volume average diameter, $D_p$, and the core toner particles have affixed to their surfaces a plurality of discrete colorant powder particles having a volume average diameter, $d_p$, wherein the ratio of $D_p/d_p$ is at least about 5 and the weight fraction of colorant powder particles is at least about 0.01 based on the combined weight of core toner particles and colorant powder particles. Preferably, the weight fraction of colorant powder particles is from about 0.3 to about 3 times the product, $(\rho_p/\rho_r)(d/r)(1+d/r)^2$, where $\rho_p$ is the density of the colorant powder particles, $\rho_r$ the density of the core resin particles, d, the volumetric mean diameter of the colorant powder particles and r the volumetric mean radius of the toner core resin particles.

25 Claims, 2 Drawing Sheets

POWDER-COATED TONER PARTICLES AND METHOD OF MAKING SAME

CLAIM FOR PRIORITY

This application claims priority based on Korean Application Number: 10-2003-0030477, filed May 14, 2003.

FIELD OF THE INVENTION

This invention generally relates to color toner compositions and a method of producing toners for developing latent electrostatic images in electro-photography, electrostatic recording and electrostatic printing. More specifically, this invention is directed to a color toner composition for developing latent electrostatic images that includes powder-coated toner particles, the powder-coated toner particles being characterized in that each comprises a core toner particle having a volume average diameter, $D_p$, and the core toner particles have affixed to their surfaces a plurality of discrete colorant powder particles having a volume average diameter, $d_p$, wherein the ratio of $D_p/d_p$ is at least about 5 and the weight fraction of colorant powder particles is at least about 0.01 based on the combined weight of core toner particles and colorant powder particles. The colorant powder is in the nanosize range as described hereinafter.

BACKGROUND OF THE INVENTION

The formation and development of images on the surface of photoconductive materials by electrostatic means is well known. The basic electrophotographic imaging process as disclosed in U.S. Pat. No. 2,297,691 describes placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or over coating treatment.

Electrostatic images formed on an electrophotographic photoconductor and an electrostatic recording medium are typically developed by using (i) a mono-component type dry developer consisting of a toner including a coloring agent such as a dye or pigment and a binder resin in which the coloring agent is dispersed, or with addition of a charge controlling agent thereto when necessary, or (ii) a two-component type dry developer including the above-mentioned powder-coated toner and solid carrier particles. Toners and developer compositions including colored particles are well known. In this regard, see U.S. Pat. Nos. 5,352,521; 4,778,742; 5,470,687; 5,500,321; 5,102,761; 4,645,727; 5,437,953; 5,296,325 and 5,200,290, the disclosures of which are hereby incorporated in their entirety by reference. A traditional toner composition typically contains toner particles consisting of a binder resin and colorants, a wax or a polyolefin, a charge control agent, flow agents and other additives. A typical toner formulation typically contains about 90–95 weight percent resin, about 2–10 weight percent colorant, about 0–6 weight percent wax, about 0–3 weight percent charge control agent, about 0.25–1 weight percent flow agent and 0–about 1 weight percent other additives. Widely-used binder's resins are styrene-acrylic copolymers, styrene-butadiene copolymers and polyesters. The colorants usually are selected from cyan dyes or pigments, magenta dyes or pigments, yellow dyes or pigments, and mixtures thereof.

In the course of an electrophotographic printing operation, toner particles are subjected to a number of complex steps such as charging, electrostatic transfer, fusing, etc. There is now a realization that toner particles must possess a balance of compositional, geometrical and physical properties to perform well in a modern electrographic printer. Examples of such properties are a small mean particle size, a uniform size distribution, fast and stable electrostatic charging, fast melting, good particle flowing characteristics, controlled presence of internal additives, such as wax and charge control agent.

For example, it is difficult to obtain resolutions better than about 600 dots/inch when the average particle size is larger than about 7 μm. For resolutions, in the order of about 1200 dots/inch, particle sizes smaller than 5 μm are typically needed. Conventionally, color toner particles are produced by a mechanical milling process, for example, described in the U.S. Pat. No. 5,102,761. In that process, an acrylate resin is compounded with a pigment, a charge control agent ("CCA"), and occasionally a wax in a melt mixer. The resulting polymer mixture is mechanically crushed and then milled into small particles. Such a conventional toner process typically produces particles with an irregular shape and a broad distribution in particle size.

Improvements in the methods of producing small toner particles with a uniform size distribution have been attempted in the past. For example, the aforementioned U.S. Pat. Nos. 5,352,521, 5,470,687 and 5,500,321 disclose toner particles produced by dispersion polymerization. In such a method, monomers (typically styrenic and acrylate monomers) and additives such as pigment, charge control agent and wax are mixed together to form a monomer dispersion. This is then further dispersed into an aqueous or a non-aqueous medium and the monomer is reacted to form toner particles. This method has the advantage over the aforementioned milling methods that spherical toner particles with a small mean diameter can be prepared. However, the polymerization involves a substantial volume contraction and it results in entrapment of the dispersion medium inside the resulting particles. Furthermore, the polymerization is difficult to complete and a substantial portion of the monomers remain in the toner particles. The residual monomers and the entrapped dispersion solvent are difficult to remove from the particles. Further, agents employed, such as dispersion-stabilizing agent and surface active agent, cause the charging characteristics and preservability of the toner particles to deteriorate by remaining on the surface of the toner particles and are difficult to remove.

Another so-called chemical method for forming small toner particles is the emulsion aggregation method disclosed in U.S. Pat. Nos. 5,916,735 and 6,268,103. In a typical emulsion aggregation method, emulsion particles of sub-micron size are first formed using an emulsion polymerization process and toner particles are produced by aggregating the emulsion particles and subsequent drying. The method consists of many delicate process steps including the aggregation step and an extensive drying step.

Additionally, the above-described chemical methods of manufacturing toner particles are applicable only for resins such as styrenic copolymer resins that are polymerized by an addition reaction. The methods therefore cannot be used for a polyester resin which is polymerized by a condensation reaction.

U.S. Pat. No. 6,132,919 discloses a high-resolution toner composition with a core-shell structure, prepared by a suspension polymerization process. In this case, core particles are first prepared by polymerizing a suspension of monomer for core resin containing a colorant and toner particles and toner particles are then prepared by polymerizing shell monomer on the surface of the core particles that are dispersed in a liquid medium. There are several important limitations with such a core-shell toner. First, the core resin is required to have a lower glass transition temperature than that of the shell resin. The amount of colorant that one can incorporate is limited. Lastly, the process is impractically complex.

There is continuing interest in developing improved toner composition including particles which have a novel arrangement of the component compounds and enabling methods of producing the toner particles with such a unique structure and properties for high-resolution color electrophotography.

SUMMARY OF THE INVENTION

There is provided in accordance with the present invention color toner composition for developing latent electrostatic images comprising powder-coated toner particles, the powder-coated toner particles being characterized in that each comprises a core toner particle having a volume average diameter, $D_p$, and the core toner particles have affixed to their surfaces a plurality of discrete colorant powder particles having a volume average diameter, $d_p$, wherein the ratio of $D_p/d_p$ is at least about 5 and the weight fraction of colorant powder particles is at least about 0.01 based on the combined weight of core toner particles and colorant powder particles. Typically, the ratio of the volume average diameter of the core toner particles to the volume average diameter of the colorant powder particles is at least about 10, preferably at least about 50, and in some cases, at least about 100.

The weight fraction of colorant powder particles usually is at least about 0.025 based on the combined weight of core toner particles and colorant particles, preferably the weight fraction of colorant powder particles is at least about 0.05 based on the combined weight of core toner particles and colorant particles. In preferred cases, the weight fraction of colorant powder particles is from about 0.3 to about 3 times the product, $(\rho_p/\rho_r)\ (d/r)\ (1+d/r)^2$, where $\rho_p$ is the density of the colorant powder particles, $\rho_r$ the density of the core resin particles, d, the volumetric mean diameter of the colorant powder particles and r the volumetric mean radius of the toner core resin particles. So also, it is preferred that 80 vol. % of the core toner particles are in the diameter range of about 0.5 to 1.5 times of the volumetric average diameter.

The resin core particles may further comprise a wax, and include a polymer selected from the group consisting of polyester resins and styrenic copolymer resins. Typically, if a wax is present, it is selected from a group consisting of paraffinic wax, ester wax, amide wax, polyethylene wax, polypropylene wax, Canauba wax and bee's wax, and the core includes a wax in the amount of from about 0 to about 30 weight percent parts of the toner composition. Optionally included is a charge control agent selected from a group consisting of negative and positive charge control agents.

The colorant powder particles typically incude a pigment selected from the group consisting of cyan, magenta, yellow and black pigments, and the toner composition may further include one or more particle flow agents selected from the group consisting of hydrophobic silica, hydrophilic silica, titanium oxide, zinc stearate, magnesium stearate, alumina, calcium titanate, polymethylmethacrylate particles, polyester particles and silicon polymer particles, as an external additive.

In one preferred embodiment, there is a particulate toner composition for development of latent electrostatic images comprising: toner particles consisting of a resin core consisting of a resin with the weight average molecular weight in the range of about 5,000 and about 40,000 g/mol and the glass transition temperature in the range of about 40° C. and about 90° C.; a colorant particle in the amount of about 3 to about 30 weight % embedded in the peripheral region of the core to form powder coated toner particles; and, optionally, a protective resin layer overcoated over the powder coated toner particles, wherein a volume average diameter of the toner particles is in the range of 3 and 12 microns with 80 vol. % of the particles in the diameter range of from about 0.5 to 1.5 times that of the volumetric average diameter.

In another preferred embodiment, there is provided a color toner composition for developing latent electrostatic images comprising powder-coated toner particles, the toner particles being characterized in that each comprises a core toner particle having a volume average diameter, $D_p$, the toner particles having affixed to their surfaces a plurality of discrete colorant powder particles having a volume average diameter, $d_p$, as well as a melt-fused protective polymer operative to secure the powder to the core toner particles, wherein the ratio of $D_p/d_p$ is at least about 5 and the weight fraction of colorant powder particles is at least about 0.01 based on the combined weight of core toner particles, colorant particles and protective resin.

A method of producing a toner composition of the present invention includes: admixing toner core particles having a volume average diameter, $D_p$, with a powder colorant composition having a volume average particle diameter, $d_p$, the ratio $D_p/d_p$ being at least about 5; and dispersing the powder colorant composition over the surfaces of the toner core particles under conditions effective to affix the powder to the surfaces of the core particles such that the core particles have a plurality of discrete toner particles of lesser size affixed to their surfaces. The method may be carried out under substantially dry conditions.

Another method of producing a toner composition of the present invention includes: admixing toner core particles having a volume average diameter, $D_p$, with a powder colorant composition having a volume average particle diameter, $d_p$, the ratio $D_p/d_p$ being at least about 5, and with a powder resin component having a volume average particle diameter, $d_{p'}$, the ratio of $D_p/d_{p'}$ also being at least about 5; dispersing the powder colorant composition and the powder resin component over the surfaces of the toner core particles under conditions effective to affix the powders to the surfaces of the core particles such that the core particles have a plurality of discrete powder particles of resin and colorant of lesser size than the core toner particles affixed to their surfaces; and melting the powder resin component to further secure the powder colorant composition to the resin core particles.

Further details will become apparent from the appended Figures and Examples.

DETAILED DESCRIPTION OF THE PREFERRED EMBODIMENTS

Figure 1:
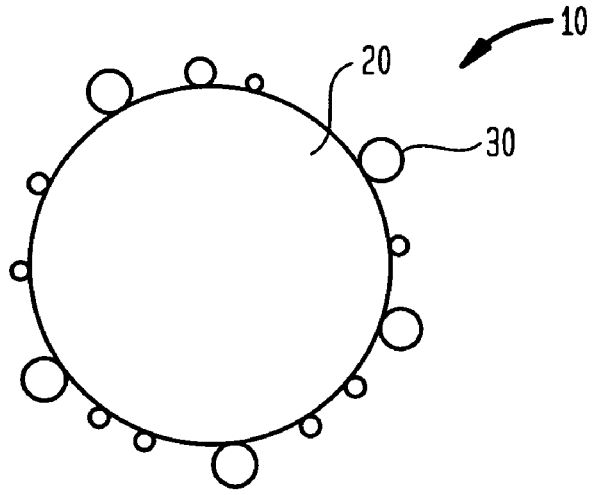
FIG. 1 is a schematic illustrating powder-coated toner particles including a meltable resin core and affixed colorant particles on the meltable resin core.

Referring to FIG. 1, a particulate toner composition includes powder-coated toner particles 10 with meltable resin core 20 and colorant particles 30 on the peripheral region of the meltable resin core. The peripheral region of the powder-coated toner particles 10 may optionally include a charge control agent, and a wax. The powder-coated toner particles may have an outermost protective layer including a protective resin with the glass transition temperature greater than 55° C. and optionally of a charge control agent. The powder-coated toner particles 10 have a volume average diameter in the range of about 3 to about 12 μm, as well as a narrow diameter distribution of 80 vol. % of the particles having the particle diameter in the range of from about 0.5 to about 1.5 times that of the volumetric average diameter.

The meltable resin core of the present invention includes a toner resin selected from a group consisting of polyester and styrenic copolymer resins. The resin is typically an amorphous resin with the glass transition temperature in the range of from about 40° C. to about 90° C. and having a weight average molecular weight in the range of from about 5000 g/mol to about 40,000 g/mol. Furthermore, the meltable resin core may encapsulate a wax in the interior section in the amount of from about 0 to about 30 wt. %. Many different types of waxes may be encapsulated in the meltable resin core particles of the present invention. Examples of a suitable wax are ester waxes, Canauba waxes, paraffin waxes, polyethylene waxes, polypropylene waxes and bee's wax. Among these, the ester waxes and the paraffin waxes are preferred.

The meltable resin core 20 may be in any shape. Resin particles of the volumetric mean diameter (D) in the range of about 3 to about 12 μm are used to be the meltable resin core of this invention. Further, the resin particles with a narrow diameter distribution are preferred in this invention. More specifically, the particles with 80 vol. % in the size range of from about 0.5D to about 1.5D are preferred.

One of a number of methods of producing resin particles may be used to prepare the meltable resin core 20 of this invention. It may be the aforementioned mechanical milling method. However, for meltable resin core particles of small volumetric mean diameter and a narrow diameter distribution, one of the methods selected from a group of suspension polymerization methods, emulsion polymerization methods, non-aqueous dispersion polymerization methods, emulsion aggregation methods and chemical milling methods is preferred.

In the powder-coated toner particles of this invention, colorant particles 30 are affixed in the periphery of the meltable resin cores 20. The affixed structure is typically formed by first forming a layer of colorant particles on the meltable resin core surface utilizing attractive electrostatic interaction between the colorant particles and the meltable resin core and subsequently affixing the colorant particles on the meltable resin core surface by subjecting the structure to a temperature higher than the glass transition temperature of the resin. The amount of affixed colorant may constitute from about 3 to about 30 wt. % of the toner composition.

The size of the colorant particles in relation to the size of meltable resin core must be carefully selected as the relative ratio determines the amount colorant one can coat on the meltable resin core surface. The maximum amount of colorant particles (W) that may be attached on the meltable resin core surface as a single particle layer is approximated by a relationship of the formula, $$W \sim 3(\rho_p/\rho_r)(d/r)(1+d/r)^2$$

where $\rho_p$ is the density of the colorant particle, $\rho_r$ the density of the resin, d the volumetric mean diameter of the colorant particles and r the volumetric mean radius of the meltable resin core. This relation assumes that the colorant particles tend to coat the meltable resin core as a monolayer. If the diameter ratio between the meltable resin core and the colorant particles, for example, is about 50, W is in the order of about 0.1. Or, one can achieve 20 wt. % colorant loading with the diameter ratio of about 20. However, it is desirable to have the colorant size substantially smaller than that of the meltable resin core to ensure that the resin particles are coated with the colorant particles rather than the other way around. For the purpose of this invention, the diameter ratio is smaller than 1/5 and, preferably, smaller than 1/10.

When the meltable resin core particles and pigment particles are admixed, surprisingly, the dissimilar particles develop opposite electrical charges and consequently attract to each other. Because the meltable resin core particles tend to be much larger than the pigment particles, the latter usually deposit themselves on the surface of meltable resin core particles. The operation can be carried out in a typical dry particle mixer, for example, a Henschel mixer. Without being bound to any theory, colorant particles can be affixed to periphery of the meltable resin core by interactions, for example, ionic, covalent, hydrophobic, hydrophilic, electrostatic, Van der Waals, or strong or weak physiochemical association.

The colorants may include commonly known pigments. The pigments are typically selected from cyan pigments, yellow pigments, magenta pigments and black pigments. Illustrative black pigments may include carbon black, aniline black, non-magnetic ferrite and magnetite. Illustrative cyan pigments may include copper phthalocyanine compounds and derivatives thereof, anthraquinone compounds, and basic dye chelate compounds. Particularly preferred cyan pigments may include C. I. Pigment Blue 1, 7, 151, 152, 153, 154, 60, 62, and 66. Illustrative magenta pigments may include condensation azo-compounds, diketopyropyrrole compounds, anthraquinone compounds, quinacridone compounds, basic dye chelate compounds, naphthol compounds, benzimidazole compounds, thioindigo compounds and perylene compounds. Particularly preferred magenta pigments may include C. I. Pigment Red 2, 3, 5, 6, 7, 23, 482, 483, 484, 811, 122, 146, 166, 169, 177, 184, 185, 202, 206, 220, 221, and 254. Illustrative yellow pigments may include condensation azo compounds, isoindolinone compounds, anthraquinone compounds, azo metal complexes, methine compounds, and allylamide compounds. Particularly preferred yellow pigments may include C. I. Pigment Yellow 12, 13, 14, 15, 17, 62, 74, 83, 93, 94, 95, 109, 110, 111, 128, 129, 147, 168 and 180.

The colorants are selected by taking into account hue, chroma, brightness, weatherability, and transparency properties. The colorants may be used alone, in the form of a mixture, or in the state of a solid solution. Further, the colorant particles may be coated with a polymer film to facilitate adhesion of the colorant particles to the meltable resin core particles.

Various known positive or negative charge controlling additives (CCA) can be incorporated in the toner compositions of the present invention, preferably in an amount of about 0.1 to about 15, more preferably from about 0.5 to about 5 wt. %. Charge control agent may be incorporated in the interior of the meltable resin core, or be affixed in the periphery of the meltable resin core along with the colorant particles, or added as external additive to the powder-coated toner particles. Examples of charge control agent may include quaternary ammonium compounds for example, alkyl pyridinium halides, alkyl pyridinium compounds, reference U.S. Pat. No. 4,298,672; organic sulfate and sulfonate compositions, U.S. Pat. No. 4,338,390; bisulfonates; ammonium sulfates (DDAES); distearyl dimethyl ammonium bisulfate (DDAMS), reference U.S. Pat. No. 5,114,821; cetyl pyridinium tetrafluoroborates; distearyl dimethyl ammonium methyl sulfate, aluminum salts, such as BONTRON E84™ or E88™ (Oriental Chemicals); quaternary ammonium nitrobenzene sulfonates; mixtures of charge enhancing additives, such as DDAMS and DDAES; other known charge additives; and the like, the disclosures of which are incorporated by reference herein in their entirety. Moreover, effective known internal and external additives may be selected for the toners of the present invention.

Figure 2:
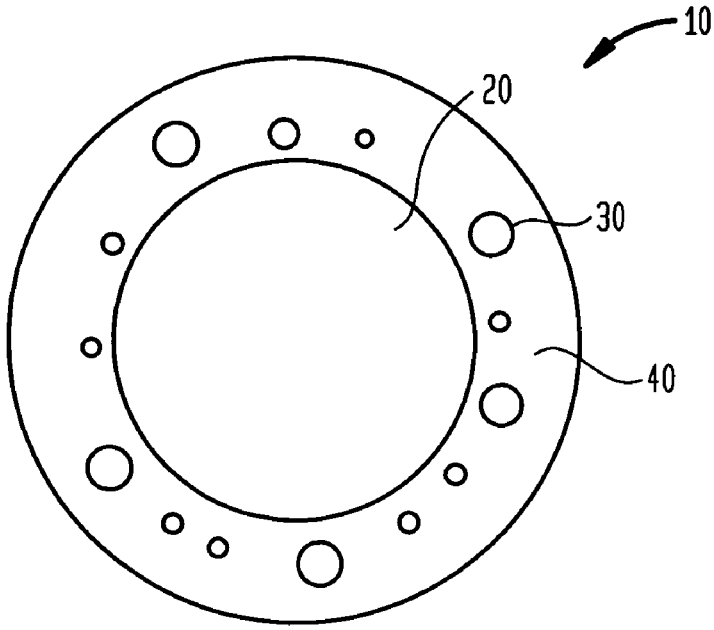
FIG. 2 is a schematic illustrating powder-coated toner particles including a meltable resin core and affixed colorant particles on the meltable resin core with an overcoating of protective polymer resin.

Referring to FIG. 2, the outermost layer of the powder-coated toner particles of this invention may include an overcoating protective resin layer 40. The resin employed for the protective layer may be selected from a group consisting of polyester and styrenic copolymer resins. The protective resin layer 40 is typically an amorphous resin with a glass transition temperature in the range of from about 40° C. to about 150° C. having a weight average molecular weight in the range of from about 5000 g/mol to about 40,000 g/mol. The resin may be the same resin comprising the meltable resin core. The amount of resin used for the protective layer is in the range of from about 0 to about 50, preferably from about 5 to about 25 wt. %. A conventional coating method for powder may be used to deposit the protective layer.

The toner particles may be blended with a suitable flowability improvement agent. They generally help to enhance the flowability of the particles during their use as color toner. Suitable flow agents are materials, for example, finely-divided particles of hydrophobic silica, titanium oxide, zinc stearate, magnesium stearate and the like which may be applied by processes such as, for example, dry mixing, solvent mixing and the like. In a typical process, a hydrophobic fumed silica (previously treated with a surface activating reagent such as, for example, hexamethyldisilazane and available under the trade name Cab-O-Sil® T-530 from Cabot Corporation, Tuscola, Ill.) is mixed with the charge control agent-coated particles and blended well in a tumble mixer for about 10–60 minutes to obtain flow agent-coated toner particles. It is preferred that the amount of flowability agents in the toner is in the range of from about 0.01 and about 10 parts per hundred relative to the finished toner weight.

In the present invention, it is preferable to produce small powder-coated toner particles which have a volume average particle diameter (D) in the range from about 3 to about 12 μm. The terms "volume average particle diameter" is defined in, for example, *Powder Technology Handbook,* 2nd edition, by K. Gotoh et al, Marcell Dekker Publications (1997), pages 3–13. More specifically, it is preferable to produce powder-coated toner particles which include particles with a particle diameter distribution in the range of 0.5 times to 1.5 times the volume average diameter in an amount of 80 wt. % or more of the entire weight of the particles. The powder-coated toner particles with such a narrow particle diameter distribution provide powder-coated toner particles which have uniform quantity of electric charge in each powder-coated toner particle, and can provide high-quality copy images with a subsequent ease of charge control in a development unit In the present invention, the particle diameter distribution is measured by a commercially available Coulter LS Particle Size Analyzer (Coulter Electronics Co., Ltd., St. Petersburg, Fla.).

The toner of the present invention can be formulated into a developer composition by mixing with carrier particles. Illustrative examples of carriers that can be selected for mixing with the toner compositions include those carriers that are capable of triboelectrically obtaining a charge of opposite polarity to that of the powder-coated toner particles. Accordingly, in embodiments, the carrier particles may be selected so as to be of an opposite polarity, for example, negative or positive polarity to depending on the polarity that of the powder-coated toner particles, which in turn may be positively or negatively charged. For example, positively charged powder-coated toner particles will adhere to and surround negatively charged carrier particles. Illustrative examples of carriers may include granular zircon, granular silicon, glass, steel, iron, nickel ferrites, such as copper zinc ferrites, copper manganese ferrites, and strontium hexaferrites, silicon dioxide, and the like. In embodiments, mixtures of coatings, such as KYNAR® and PMMA as illustrated in U.S. Pat. Nos. 4,937,166 and 4,935,326, mixtures of three polymers, mixtures of four polymers, polymer mixture pairs wherein each pair contains a conductive carrier coating and an insulating earner coating, can be selected. The carrier coating can be selected in various effective amounts, such as, for example, from about 0.1 to about 10 weight percent.

Another embodiment of the present invention provides a method for producing a particulate toner composition for development of latent electrostatic images comprising powder-coated toner particles including a meltable resin core and colorants affixed in the peripheral region of the meltable resin core and optionally a protective resin layer coated over the core resin surface and further have the volume average diameter in the range of from about 3 to about 12 μm with 80 vol. % of the particles in the diameter range of from about 0.5 and about 1.5 times that of the volumetric average diameter. The method comprises charging a meltable dry meltable resin core comprising a resin with a glass transition temperature in the range of from about 40° C. to about 90° C. and colorant particles into a dry particle mixer; affixing colorant particles on the surface of the meltable resin core to form powder coated resin particles in the dry mixer; and optionally, fusing a protective resin as an overcoating on the powder coated resin particles.

The disclosed method of producing toner affords a number of important technical and commercial advantages. It enables production of toners with a small mean diameter and a narrow diameter distribution while containing a high level of colorant loading. For a high-resolution toner with a small particle diameter in the order of 3–12 microns, it is imperative to have a high colorant loading to realize the high-resolution image with a sufficiently high optical density. The method, comprising a dry blending method that utilizes a surprising finding of attractive triboelectric charging behavior of dissimilar particles, is simple and reproducible, thereby offering a significant economical advantage over existing methods of toner production.

Desirable characteristics of the meltable resin core particles were described earlier. Most importantly, the mean particle diameter and diameter distribution need to be carefully regulated as the mean diameter and diameter distribution of the toner particles are primarily determined by the properties of meltable resin core particles.

The average diameter of toner particles needs to be smaller as the image resolution of a laser printer increases. However, even with the small size toners, the high image resolution also requires the file height of toner layer on paper to be small. This then necessitates a high colorant loading in the small size toner. Typically, 600 dpi toner particles contain a colorant in the amount about 5–8 wt. % with the particle mean diameter in the order of 8 μm. However, to achieve 2400 dpi resolution, it is expected that the toner particles diameter needs to be from about 3 about 4 μm and the colorant loading in the order of from about 15–20 wt. %. Accomplishing this with a conventional melt blending creates several significant difficulties. First, dispersing such a large amount of colorant in a resin requires a long and extensive mixing operation, which is expensive and often results in degradation of the resin. The particle formation process also becomes difficult to control as the dispersed colorant particles act as physical crosslinks. In contrast, the process of this invention allows incorporation of a large amount of colorant particles onto toner particles in a reproducible manner.

Deposition of resin microparticles with the protective resin layer is also carried out in the dry particle mixer using triboelectric charging between dissimilar particles. The protective layer protects the colorant particles from being detached off the meltable resin core particle surface while being intermixed with carrier particles. For a similar reasoning to the above paragraph, the resin microparticles can include a mean diameter of ⅕ of the meltable resin core diameter and, preferably, 1/10 of the meltable resin core diameter. The amount of resin microparticles used was in the range of from about 0 to about 50 wt. % of the meltable resin core.

Electrostatic attractive force and van der Waals interaction between the meltable resin core particles, the colorant particles and the resin microparticles maintain the overall particle structure in a mild agitating condition. However, toner particles in a printer are subjected to considerable shearing stress. In a two-component development system, the toner particles are admixed with carrier particles and the developer composition is vigorously stirred to generate triboelectric charge on the toner particles. Alternatively, in a single-component development system, the toner particles are sheared against a charging roller or charging bar. It therefore is required to build a strong adhesion between the toner particles so that the vigorous shearing does not remove the colorant particles or the resin microparticles from the surface of the toner particles. This is typically achieved by subjecting the toner particles at a temperature higher than the glass transition temperature for an extended period while taking care not to have agglomeration of the toner particles. In practice, the resin particles coated with colorant particles and resin microparticles are dispersed in a bath containing an aliphatic hydrocarbon liquid medium, the temperature of the content is raised to about 100° C. and the particles are maintained with a mild agitation for about 30 minutes. Subsequently, the toner particles are cooled and the toner particles are separated by filtration and washed.

The features of the present invention are further illustrated by the following examples, which are given for illustration of the invention and are not intended to be limiting thereof.

Example 1

White Meltable Resin Core Particles with 7 μm Average Diameter 200 g of ethyl acetate (Ethyl Acetate, Samchun Fine Chemicals, Pyungtaik, Korea) was introduced into a 1-l beaker and its temperature was raised to 70° C. Then, 100 g of a polyester resin (Toner Polyester Resin No. 2, DPI Solutions, Daejeon, Korea) which had the weight average molecular weight of 14,000 g/mol and the glass transition temperature of 62° C. and 20 g of an ester wax (Ester Wax G-32, Henckel Corporation, Dusseldorf, Germany) with the melting temperature of 55° C. were dissolved in the solvent by maintaining the content under agitation for about 1 hour.

Separately, in a 1-liter glass reactor equipped with a reflux condenser, 5 g of poly-(vinyl alcohol) (Polinol P-24, Dongyang Jechul Chemical, Seoul, Korea) was dissolved in 350 g of distilled water maintained at 70° C. by stirring the content for 2 hours at the agitator speed or 200 rpm. Once the solution became clear, the agitator speed was raised to 350 rpm and the resin-wax solution above was introduced and maintained at the stirring condition for 1 hour.

Then, refluxing of ethyl acetate back into the reactor was stopped by turning off the cooling water to the condenser and the reactor temperature is raised to 75° C. to evaporate ethyl acetate off the reactor. After removing 60 g of ethyl acetate off the reactor, the refluxing was resumed, 2.5 g of sodium dodecyl sulfate (Junsei Chemical, Tokyo, Japan) is added into the reactor and the content is stirred for 10 minutes. Then the condenser cooling water is turned off completely and the reactant temperature is raised gradually to 95° C. so that ethyl acetate evaporated off the reactor completely and a dispersion of resin-wax particles in water remained. The dispersion was cooled down to ambient temperature (24° C.) and filtered to obtain crude resin particles. The crude resin particles were re-dispersed in water and re-filtered. This step was repeated five times. The particles were dried at 30° C. in a convection oven for 48 hours. Approximately 105 g of white resin-wax particles were obtained.

Figure 3:
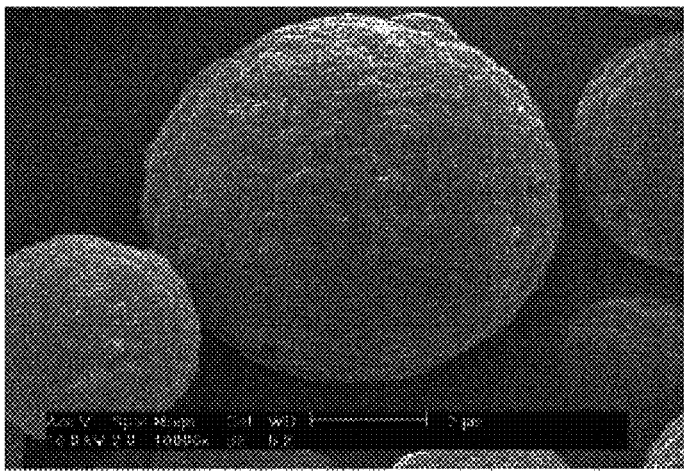
FIG. 3 is a scanning electron micrograph of meltable resin core particles in the absence of adhering colorant particles.

Referring to FIG. 3, scanning electron microscopy examination showed that the white particles so prepared were spherical in shape with the wax component encapsulated in the interior of particles. They had a volume average mean diameter of 7 μm and the 80% span of 0.6. The wax content of the white particle composition was about 18 wt. % when determined using a differential scanning calorimetry method.

Example 2

A Yellow Toner Composition with Colorant-coating 10 g of the white particles of Example 1 and 0.5 g of a yellow pigment (Bayplast Yellow 5GN 01, Bayer AG, Liverkusen, Germany) were charged into a laboratory particle mixer (MT-2000, Magic Touch Corporation, Taegu, Korea). Examination of the colorant particles with a scanning electron microscope showed the particle size to be in the region of about 30 nm and about 100 nm. The content was stirred at the agitator speed of 15,000 rpm for 5 minutes and the colorant particles coated the surface of resin particle. Then, 0.3 g of a charge control agent (Copy-Charge N4P, Clariant Frankfurt, Germany) was added into the mixer and the content was agitated for 2.5 minutes. Lastly 0.1 g of a particulate silica composition (Aerosil R805, Degussa-Huls, Frankfurt, Germany) was added as a particle flow agent in the mixer and the content was agitated for additional 2.5 minutes to obtain approximately 8 g of finished single component toner composition.

Figure 4:
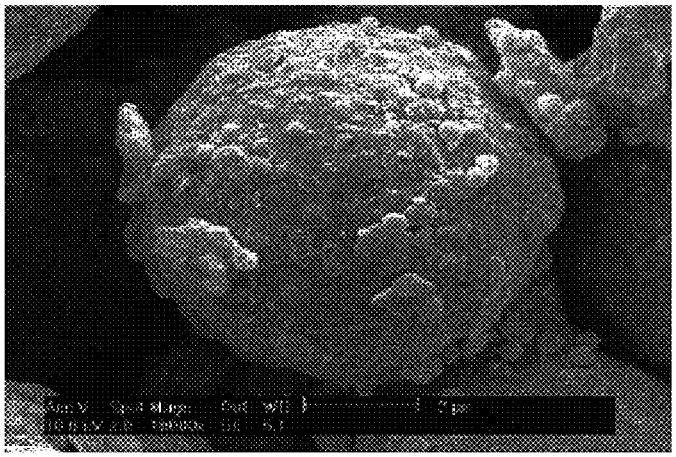
FIG. 4 is a scanning electron micrograph of a toner composition that includes meltable resin core particles and colorant particles affixed in the peripheral region of the meltable resin core particles.

Referring to FIG. 4, scanning electron microscopy of the particles confirmed that the colorant particles and the charge control agent particles are securely adhered to the meltable resin core surface. Electrostatic charging properties of the yellow toner composition were determined by a blow-off method using a Faraday cage (Vertex Charge Analyzer, Vertex Image Products, Yukon, Pa.). The charge of toner after 1 minute mixing with Type-22 carrier was −27 μC/g. Fusing property of the toner was determined using a custom-designed heated roll-type fusing tester. A small amount of toner was spread on a sheet of paper and was passed through a pair of heated roller at a linear speed of about 720 cm/min. When the roller temperature was below 140° C., cold offset phenomena was observed and, above 220° C., hot offset was observed, resulting in a very large fusing latitude of 80° C. for the toner composition. Further, the toner sample was introduced into a cartridge of HP-4500 printer and patterns were printed. Line acuity and solid patches with a uniform optical intensity 1.17 of were observed after printing 5,000 pages.

Example 3

A Magenta Toner Composition

A magenta toner composition was prepared by following the procedure of Example 2 with the exception that 0.5 g of the yellow colorant was replaced by 0.5 g of a magenta pigment (Quindo Magenta RV-6832, Bayer AG, Liverkusen, Germany) with the mean particle diameter ($D_{50}$) less than 50 nm. The magenta toner exhibited triboelectric charge of −8 μC/g after 1 minute blending with Type 22 carrier particles. The fusing latitude was 40° C. from 160° C. to 200° C.

Example 4

A Cyan Toner Composition with a Protective Resin Layer 10 g of the white particles of Example 1 and 0.5 g of a cyan pigment (Hostaperm Blue BG, Clariant, Frankfurt, Germany) with $D_{50}$ less than 50 nm were charged into a laboratory particle mixer (MT-2000, Magic Touch Corporation, Taegu, Korea). The content was stirred at the agitator speed of 15000 rpm for 5 minutes so that the colorant particles were deposited on the resin particle surface. Additionally, 2 g of microparticles of a protective resin, polyester toner resin (DPI Solutions, Daejeon, Korea) was charged and mixed for 2.5 minutes. Particle diameter of the polyester microparticles was determined using a laser scattering method. $D_{50}$ was 0.47 μm and the 80% span 0.3. The dry blended particle mixture was introduced into a beaker containing 20 g of Isopar-L and a dispersion was formed. The temperature was raised to 90° C. and the content was maintained under agitation for 10 minutes so that the meltable resin core, the pigment and the resin microparticles fused together. Subsequently, toner particles were separated from the medium and washed with n-hexane three times. Then, 0.3 g of a charge control agent (Copy-Charge N4P, Clariant Frankfurt, Germany) was blended with 10 g of the dried toner particles in a mixer 2.5 minutes. Lastly 0.1 g of a particulate silica composition (Aerosil R805, Degussa-Huls, Frankfurt, Germany) was added as a particle flow agent in the mixer and the content was agitated for additional 2.5 minutes to obtain approximately 11 g of finished single component toner composition.

Scanning electron microscopic examination showed that a contiguous protective layer was formed on the surface of meltable resin core, as shown schematically in FIG. 2. The blue toner exhibited triboelectric charge of −8 μC/g after 1 minute blending with Type 22 carrier particles. The fusing latitude was 40° C. from 160° C. to 200° C.

Example 5

A Black Toner Composition with a Protective Resin Layer

A black toner composition was prepared by following the procedure of Example 4 with the exception that 0.5 g of the cyan pigment was replaced by 0.5 g of carbon black pigment (Spezialschwarz 4, Frankfurt, Germany) with the particle diameter in the range of about 30 nm to about 100 nm according to scanning electron microscopy. The magenta toner exhibited triboelectric charge of −5 μC/g after 1 minute blending with Type 22 carrier particles. The fusing latitude was 40° C. from 160° C. to 200° C.

Example 6

A Magnetic Black Toner Composition with a Protective Resin Layer

A magnetic black toner composition (MICR) was prepared by following the procedure of Example 4 with the exception that 0.5 g of the cyan pigment was replaced by 1.0 g of a magnetite pigment (Treated magnetite MBDS-5, Rockwood Pigment NA, St. Louis, US) with $D_{50}$ less than 50 nm. The magenta toner exhibited triboelectric charge of −12 μC/g after 1 minute blending with Type 22 carrier particles. The fusing latitude was 70° C. from 150° C. to 220° C.

Example 7

A Yellow Toner Composition with a High Optical Density Value

A yellow toner composition with a high optical density value was prepared by following the procedure of Example 2 with the exception that 0.5 g of the yellow pigment was replaced by 1.0 g of the same yellow pigment. The yellow toner exhibited the fusing latitude was 50° C. from 180° C. to 230° C. The toner sample was introduced into a cartridge of HP-4500 printer and patterns were printed. Line acuity and solid patches with a uniform optical intensity 1.65 after printing 5,000 pages comparison to the optical density of 1.15 for the toner composition of Example 2.

Example 8

A Yellow Toner Composition with a High Optical Density Value

A yellow toner composition with a high optical density value was prepared by following the procedure of Example 2 with the exception that 0.5 g of the yellow pigment was replaced by 2.0 g of the same yellow pigment. The yellow toner exhibited the fusing latitude was 50° C. from 180° C. to 230° C. The toner sample was introduced into a cartridge of HP-4500 printer and patterns were printed. Line acuity and solid patches with a uniform optical intensity 2.28 after printing 5,000 pages comparison to the optical density of 1.15 for the toner composition of Example 2.

Example 9

A Yellow Toner with Internal Charge Control Agent

Approximately 105 g of white core resin containing a charge control agent were prepared by following the same procedure as in Example 1 with the exception that 0.3 g of Copy-Charge N4P was added to the polymer-wax solution in acetate solution.

10 g of the white particles of Example 1 and 0.5 g of a yellow pigment (Bayplast Yellow 5GN 01, Bayer AG, Liverkusen, Germany) were charged into a laboratory particle mixer (MT-2000, Magic Touch Corporation, Taegu, Korea). The content was stirred at the agitator speed of 15,000 rpm for 5 minutes and the colorant particles coated the surface of resin particle. Then the agitation speed was lowered to about 200 rpm while the mixture was heated to 70° C. and maintained at the temperature for about 20 minutes. Subsequently the content was slowly cooled down to ambient temperature. Lastly 0.1 g of a particulate silica composition (Aerosil R805, Degussa-Huls, Frankfurt, Germany) was added as a particle flow agent in the mixer and the content was agitated for additional 2.5 minutes to obtain approximately 8 g of finished single component toner composition.

The charge of toner after I minute mixing with Type-22 carrier was −20 μC/g. Fusing properties of the toner was determined at a linear speed of about 720 cm/min. The cold offset temperature was 140° C. and the hot offset temperature 220° C., resulting in a large fusing latitude of 70° C. for the toner composition. Further, printing test of the toner sample using a HP-4500 printer gave good line acuity and solid patches with a uniform optical intensity 1.16 after 5,000 pages of printing.

Example 10

A Yellow Toner Composition with a Small Particle Diameter and High Optical Density 200 g of ethyl acetate was introduced into a 1-l beaker and its temperature was raised to 70° C. Then, 100 g of a DPI polyester resin and 20 g of an ester wax (Ester Wax G-32, Henckel Corporation, Dusseldorf, Germany) with the melting temperature of 55° C. were dissolved in the solvent by maintaining the content under agitation for about 1 hour.

Separately, in a 1 liter glass reactor equipped with a reflux condenser, 4.8 g of poly-(vinyl alcohol) (Dongyang Jechul Chemical, Seoul, Korea) was dissolved in 350 g of distilled water maintained at 70° C. by stirring the content for 2 hours at the agitator speed or 200 rpm. Once the solution became clear, the agitator speed was raised to 350 rpm and the resin-wax solution above was introduced and maintained at the stirring condition for 1 hour.

Then, refluxing of ethyl acetate back into the reactor was stopped by turning off the cooling water to the condenser and the reactor temperature is raised to 75° C. to evaporate ethyl acetate off the reactor. After removing 80 g of ethyl acetate off the reactor, the refluxing was resumed, 2.3 g of sodium dodecyl sulfate (Junsei Chemical, Tokyo, Japan) is added into the reactor and the content is stirred for 10 minutes. Then the condenser cooling water is turned off completely and the reactant temperature is raised gradually to 95° C. so that ethyl acetate evaporated off the reactor completely and a dispersion of resin-wax particles in water resin particles. The dispersion was cooled down to ambient temperature and filtered to obtain crude resin particles. The crude resin particles were re-dispersed in water and re-filtered. This step was repeated five times. The particles were dried at 30° C. in a convection oven for 48 hours. Approximately 105 g of white resin-wax particles were obtained, which were spherical in shape with the wax component encapsulated in the interior of particles. They had a volume average mean diameter of 5 μm and the 80% span of 0.6. The wax content of the white particle composition was about 18 wt. %.

The white particles, 10 g and 2.0 g of a yellow pigment (Bayplast Yellow 5GN 01, Bayer AG, Liverkusen, Germany) were charged into a laboratory particle mixer (MT-2000, Magic Touch Corporation, Taegu, Korea). The contents were stirred at the agitator speed of 15,000 rpm for 5 minutes and the colorant particles coated the surface of resin particle. Then, 0.3 g of a charge control agent (Copy-Charge N4P, Clariant Frankfurt, Germany) was added into the mixer and the content was agitated for 2.5 minutes. Lastly, 0.1 g of a particulate silica composition (Aerosil R805, Degussa-Huls, Frankfurt, Germany) was added as a particle flow agent in the mixer and the content was agitated for additional 2.5 minutes to obtain approximately 8 g of finished single component toner composition.

The charge of toner after I minute mixing with Type-22 carrier was −10 μC/g. Fusing properties of the toner was determined at a linear speed of about 720 cm/min. The cold offset temperature was 160° C. and the hot offset temperature 200° C., resulting in a fusing latitude of 40° C. for the toner composition. Further, printing test of the toner sample using a HP-4500 printer gave good line acuity and solid patches with a uniform optical intensity 2.4 after 5,000 pages of printing. The results demonstrate that the toner preparation method of the present invention can produce toner particles with a small average particle diameter and an exceptionally high optical density.

While the invention has been illustrated and described in connection with numerous embodiments, modification to such embodiments within the spirit and scope of the present invention will be readily apparent to those of skill in the art. The invention is defined in the appended claims.

What is claimed is:

1. A method of producing a toner composition for developing latent electrostatic images comprising the steps of:

(a) providing core toner particles comprising a meltable resin with a volumetric mean diameter in the range of about 3 to about 12 μm; and (b) mixing the core toner particles with colorant powder particles at a sufficient shear rate and for a sufficient time such that the colorant particles are directly adhered to the surface of the core toner particles primarily by electrostatic forces, wherein the colorant is present in the toner composition in amounts of from 3 to 30 weight percent, and wherein the ratio of the volume average diameter of the core toner particles to the volume average diameter of the colorant powder particles is at least about 5.

2. The method according to claim 1, wherein the ratio of the volume average diameter of the core toner particles to the volume average diameter of the colorant powder particles is at least about 10.

3. The method according to claim 1, wherein the ratio of the volume average diameter of the core toner particles to the volume average diameter of the colorant powder particles is at least about 50.

4. The method according to claim 1, wherein the ratio of the volume average diameter of the core toner particles to the volume average diameter of the colorant powder particles is at least about 100.

5. The method according to claim 1, wherein the weight fraction of colorant powder particles is at least about 0.025 based on the combined weight of core toner particles and colorant particles.

6. The method according to claim 1, wherein the weight fraction of colorant powder particles is at least about 0.05 based on the combined weight of core toner particles and colorant particles.

7. The method according to claim 1, wherein the weight fraction of colorant powder particles is from about 0.3 to about 3 times the product, $(\rho_p/\rho_r)\ (d/r)\ (1+d/r)^2$, where $\rho_p$ is the density of the colorant powder particles, $\rho_r$ the density of the core resin particles, d, the volumetric mean diameter of the colorant powder particles and r the volumetric mean radius of the toner core resin particles.

8. The method according to claim 1, wherein 80 vol. % of the core toner particles are in the diameter range of about 0.5 to 1.5 times of the volumetric average diameter.

9. The method according to claim 1, wherein the resin core particles further comprise a wax.

10. The method according to claim 9, wherein the resin core comprises a polymer selected from the group consisting of polyester resins and styrenic copolymer resins.

11. The method according to claim 9, wherein the wax is selected from a group consisting of paraffinic wax, ester wax, amide wax, polyethylene wax, polypropylene wax, Canauba wax and bee's wax.

12. The method according to claim 9, wherein the resin core comprises a wax in the amount of from about 0 to about 30 weight percent parts of the toner composition.

13. The method according to claim 1, wherein the toner composition further comprises a charge control agent selected from a group consisting of negative and positive charge control agents.

14. The method according to claim 1, wherein the colorant powder particles comprise a pigment selected from the group consisting of cyan, magenta, yellow and black pigments.

15. The method according to claim 1, wherein the toner composition further comprises one or more particle flow agents selected from the group consisting of hydrophobic silica, hydrophilic silica, titanium oxide, zinc stearate, magnesium stearate, alumina, calcium titanate, polymethylmethacrylate particles, polyester particles and silicon polymer particles, as an external additive.

16. A method of producing a toner composition for developing latent electrostatic images comprising:

(a) admixing toner core particles having a volume average diameter, $D_p$, with a powder colorant composition having a volume average particle diameter, $d_p$, the ratio $D_p/d_p$ being at least about 5, and with a powder resin component having a volume average particle diameter, $d_{p'}$, the ratio of $D_p/d_{p'}$ also being at least about 5;

(b) dispersing the powder colorant composition and the powder resin component over the surfaces of the toner core particles under conditions effective to affix the powders to the surfaces of the core particles such that the core particles have a plurality of discrete powder particles of resin and colorant of lesser size than the core toner particles affixed to their surfaces, wherein the colorant composition is affixed to the surface of the core toner particles primarily by electrostatic forces and is present at a colorant loading of from 3 to 30 percent; and (c) subsequently melting the powder resin component to further secure the powder colorant composition to the resin core particles.

17. The method according to claim 16, carried out under substantially dry conditions.

18. The method according to claim 1, further comprising the step of:

(c) further bonding the colorant particles on the core toner particles by subjecting the mixture to a temperature higher than the glass transition temperature of the meltable resin.

19. The method according to claim 1, wherein the core toner particles comprise a meltable resin with a glass transition temperature in the range of from 40° C. to 90° C.

20. The method according to claim 1, wherein the colorant is present in the toner composition in amounts of from 15 to 20 weight percent.

21. The method according to claim 20, wherein the core toner particles have a volumetric mean diameter in the range of about 3 to about 4 μm.

22. The method according to claim 1, wherein the core toner particles and colorant composition are admixed in a dry particle mixer.

23. A toner composition that is prepared according to the method of claim 1.

24. A particulate toner composition for developing latent electrostatic images consisting essentially of a resin core and colorant composition particles, where the resin core has a volume average diameter, $D_p$, and the colorant composition particles have a volume average $d_p$, wherein the ratio of $D_p/d_p$ is at least about 5 and the weight fraction, wherein the colorant particles are directly adhered to the surface of the resin core, in amounts of from 3 to 30 weight percent of the toner composition.

25. The particulate toner composition according to claim 24, wherein the resin core has a weight average molecular weight in the range of about 5,000 and about 40,000 g/mol and a glass transition temperature in the range of about 40° C. and about 90° C.; wherein a volume average diameter of the toner particles is in the range of 3 and 12 microns with 80 vol. % of the particles in the diameter range of from about 0.5 to 1.5 times that of the volumetric average diameter.

* * * * *